US005162289A

United States Patent [19]

Betts et al.

[11] Patent Number: 5,162,289

[45] Date of Patent: Nov. 10, 1992

[54] PRESSURE-SENSITIVE COPYING PAPER

[75] Inventors: Gillian H. Betts, Pembury; Terence Reid, Hempstead, both of England

[73] Assignee: The Wiggins Teape Group Limited, Basingstoke, England

[21] Appl. No.: 674,444

[22] Filed: Mar. 25, 1991

[30] Foreign Application Priority Data

Mar. 27, 1990 [GB] United Kingdom ..... 9006820

[51] Int. Cl.[5] ..... B41M 5/40

[52] U.S. Cl. ..... 503/226; 427/152; 503/200; 503/207

[58] Field of Search ..... 503/200, 207, 226; 427/152

[56] References Cited

U.S. PATENT DOCUMENTS

| | | | |
|---|---|---|---|
| 2,800,457 | 7/1957 | Green et al. | 252/316 |
| 2,800,458 | 7/1957 | Green | 252/316 |
| 2,890,969 | 6/1959 | Schossberger et al. | 117/36 |
| 3,024,927 | 3/1962 | Quayle | 214/131 |
| 3,041,289 | 6/1962 | Katchen et al. | 252/316 |
| 3,287,154 | 11/1966 | Haas | 117/36.9 |
| 3,565,666 | 2/1971 | Phillips, Jr. | 117/36.2 |
| 3,620,801 | 11/1971 | O'Grady | 117/36.2 |
| 3,672,935 | 6/1972 | Miller et al. | 117/36.8 |
| 3,753,761 | 8/1973 | Sugahara et al. | 117/36.2 |
| 3,819,398 | 6/1974 | Powell et al. | 117/36.2 |
| 3,869,307 | 3/1975 | Newman et al. | 117/36.1 |
| 3,914,470 | 10/1975 | Lewis | 427/202 |
| 4,001,140 | 1/1977 | Foris et al. | 427/151 |
| 4,105,823 | 8/1978 | Hasler et al. | 428/307 |
| 4,612,254 | 9/1986 | Ginter et al. | 503/216 |
| 5,071,823 | 12/1991 | Matsushita et al. | 503/227 |

FOREIGN PATENT DOCUMENTS

| | | |
|---|---|---|
| 0291315 | 11/1988 | European Pat. Off. . |
| 0341715 | 11/1989 | European Pat. Off. . |
| 2135720 | 3/1972 | Fed. Rep. of Germany . |
| 2012541 | 3/1970 | France . |
| 55-86789 | 6/1980 | Japan . |
| 55-140590 | 11/1980 | Japan . |
| 60-248390 | 12/1985 | Japan . |
| 62-5886 | 1/1987 | Japan . |
| 63-281886 | 11/1988 | Japan . |
| 64-22588 | 1/1989 | Japan . |
| 64-30783 | 2/1989 | Japan . |
| 64-30785 | 2/1989 | Japan . |
| 64-36483 | 2/1989 | Japan . |
| 64-36484 | 2/1989 | Japan . |
| 64-58584 | 3/1989 | Japan . |
| 1222187 | 2/1971 | United Kingdom . |
| 1229503 | 4/1971 | United Kingdom . |
| 1270632 | 4/1972 | United Kingdom . |
| 1274667 | 5/1972 | United Kingdom . |
| 1277644 | 6/1972 | United Kingdom . |
| 1337140 | 11/1973 | United Kingdom . |
| 1370081 | 10/1974 | United Kingdom . |
| 1389122 | 4/1975 | United Kingdom . |
| 1463017 | 2/1977 | United Kingdom . |
| 1468398 | 3/1977 | United Kingdom . |
| 1488554 | 10/1977 | United Kingdom . |
| 1535654 | 12/1978 | United Kingdom . |
| 2022646 | 12/1979 | United Kingdom . |
| 2048331 | 12/1980 | United Kingdom . |
| 2173225 | 10/1986 | United Kingdom . |

OTHER PUBLICATIONS

Casey, *Pulp and Paper: Chemistry and Chemical Technology*, 3d Ed., vol. IV (1983), 2073-74, John Wiley & Sons, New York.

Dow Material Safety Data Sheet, "Plastic Pigment 722E".

Hemenway et al., "Hollow-Sphere Polymer Pigment in Paper Coating", *Proceedings*, 1984 TAPPI Coating Conference.

Haskins et al., "Hollow-Sphere Pigment Improves Gloss, Printability of Paper", *Pulp & Paper*, May 1989.

*Paper Coating Pigments*, TAPPI Monograph No. 38 (1976).

Product brochure, "Ropaque OP-90, Opaque Polymer for Paper Coatings", Rhom & Haas Company, (1984).

*Primary Examiner*—Pamela R. Schwartz

*Attorney, Agent, or Firm*—Burns, Doane, Swecker & Mathis

[57] ABSTRACT

A subcoat of plastic pigment particles and a binder is provided beneath the microcapsule coating of otherwise conventional pressure-sensitive copying paper of the CB or CFB type. The plastic pigment particles may be hollow or solid. Inorganic pigment particles are preferably also present in the subcoat. The binder may be a mixture of styrene/butadiene latex and polyvinyl alcohol. The subcoat typically has a coatweight of 3 to 6 g $m^{-2}$. The presence of the plastic pigment subcoat improves copying intensity, or permits a desired given copy intensity to be obtained at a lower microcapsule coatweight.

8 Claims, No Drawings

PRESSURE-SENSITIVE COPYING PAPER

This invention relates to pressure-sensitive copying paper, also known as carbonless copying paper.

Pressure-sensitive copying paper is well-known and is widely used in the production of business forms sets. Various types of pressure-sensitive copying paper are known, of which the most widely used is the transfer type. A business forms set using the transfer type of pressure-sensitive copying paper comprises an upper sheet (usually known as a "CB" sheet) coated on its lower surface with microcapsules containing a solution in an oil solvent of at least one chromogenic material (alternatively termed a colour former) and a lower sheet (usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules, thereby releasing or transferring chromogenic material solution on to the colour developer composition and giving rise to a chemical reaction which develops the colour of the chromogenic material and so produces a copy image.

The present invention is particularly concerned with base paper for coating with microcapsules to provide paper which may be converted into upper (CB) or intermediate (CFB) sheets of the kind just described, and with the use of the microcapsule-coated base paper in pressure-sensitive copying sets.

Manufacturers of pressure-sensitive copying papers continually seek to improve the copy image intensity obtainable with their products, and/or to achieve a copy image of a given acceptable intensity using reduced quantities of one or more of the imaging reactants.

The present invention is directed to achieving these objects, and is based on the discovery that improved copy image formation is obtained if the base paper to be coated with microcapsules is first pre-coated with a coating composition comprising plastic pigment particles. These plastic pigment particles may be hollow or solid. The pre-coat preferably also contains an inorganic pigment filler as an extender.

The use of a pre-coat on base paper to be coated with microcapsules is not in itself novel. For example, British Patent Application No. 2022646A discloses the use of a pre-coat comprising finely divided inorganic particles and a binder. The use of such a pre-coat is said to give good ballpoint pen writeability and good printinq ink receptivity on the microcapsule-coated surface of the paper, and to give rise to sharp copy images on an adjacent colour developer sheet.

British Patent No. 1535654 discloses the use of a barrier layer comprising clay and an alkali metal sulphite between a groundwood base paper and a microcapsule coating. The barrier layer is said to prevent yellowing of the base paper.

British Patent No. 1222187 discloses the use of a coating of organic polymer latex beneath a microcapsule coating. The latex coating is said to be deformable and therefore to cushion and protect the microcapsules against premature rupture on handling, stacking and storing of the microcapsule-coated paper. The use of an additional undercoat of a film-forming hydrophilic polymeric material such as polyvinyl alcohol is also disclosed. This additional undercoat is said to seal the base paper and thereby minimise penetration into the base paper of the more expensive subsequently-applied latex coating.

British Patent No. 1274667 discloses the use of a coating of insolubilised alginate and starch beneath a microcapsule coating on a fibrous sheet material base. The use of such an alginate/starch coating instead of just starch, as was conventional, is said to give rise to a considerable saving in microcapsule usage.

U.S. Pat. No. 3,287,154 discloses the use of sizing or barrier sub-coatings on base paper to prevent the mark-forming materials from being absorbed too deeply into the paper or even striking through the paper. Clays and waxes are disclosed as suitable constituents of such barrier coatings.

British Patent Application No. 2173225A discloses the use of a subbing layer effective to aggregate the microcapules in a subsequently applied microcapsule coating so as to prevent the microcapsules from permeating into the base paper. The subbing layer contains a flocculating agent, and optionally also a binder, a latex, a pigment, a water repellent or other additives.

British Patent No. 1463017 discloses the use of a barrier layer between a layer of microcapsules containing coloured writing material and a base paper. The components used in the barrier layer are not disclosed.

British Patent No. 1370081 discloses the use of a layer of a binder and a protective agent effective to inhibit premature microcapsule rupture beneath a subsequently applied microcapsule coating. This represents a variant on the well-established technique of incorporating the protective agent within the microcapsule layer itself.

British Patent No. 1337140 discloses a plastics film coated with microcapsules and carrying a subcoat of a layer of finely granular solid material between the plastics film and the microcapules.

European Patent Application No. 291315A discloses a heat-sensitive recording material carrying a subbing layer between a paper base and a heat-sensitive layer. The subbing layer comprises fine, preferably hollow, particles of thermoplastic resin, a binder and, optionally, a pigment. Somewhat similar disclosures are to be found in European Patent Application No. 341715A and in Japanese Patent Publications Nos. 55-86789; 55-140590; 60-248390; 62-5886; 63-281886; 64-22588; 64-30783; 64-30785; 64-36483; 64-36484; and 64-58584.

Plastic pigment particles, including hollow plastic pigment particles, are themselves well-known in the paper industry as constituents of coating compositions. Solid plastic pigments form the subject of Chapter 6 of Tappi Monograph No. 38 entitled "Paper Coating Pigments", published 1976, and are also the subject of a sub-section on pages 2073 and 2074 of "Pulp & Paper—Chemistry & Chemical Technology" edited by James P. Casey, 3rd Edition, Volume IV, published in 1976 by John Wiley & Sons. Examples of patents on plastic pigments and/or their use in paper coatings are British Patents Nos. 1229503; 1468398 and 1488554. Hollow plastic pigments and their use in paper coatings are disclosed in British Patents Nos. 1270632 and 1389122; in a paper given at the 1984 Tappi Coating Conference by C. P. Hemenway, J. J. Latimer and J. E. Young entitled "Hollow-Sphere Polymer Pigment in Paper Coating" and in an article entitled "Hollow-Sphere Pigment Improves Gloss, Printability of Paper" by W. J. Haskins and D. I. Lunde in "Pulp & Paper", May 1989 edition. Similar hollow plastic pigments are also the subject of product information literature published by Rohm & Haas Company of Philadelphia, USA in relation to its products sold under the trade mark "Ropaque".

Despite these numerous previous proposals for the use of pre-coats or sub-coats beneath microcapsule coatings, and for the use of hollow plastic pigments as paper loadings or in paper coatings, including sub-coats for heat-sensitive recording materials, it had not been appreciated prior to the present invention that the use of a sub-coat comprising plastic pigment particles, preferably hollow particles, beneath a microcapsule coating as conventionally used in pressure-sensitive copying papers of the transfer type would give rise to substantially improved copy image formation for a given microcapsule coatweight, or to equivalent copy image formation at a reduced microcapsule coatweight.

Accordingly, the present invention provides pressure-sensitive copying paper comprising:

a paper base;

a coating of pressure-rupturable microcapsules on the paper base, the microcapsules containing a solution in an oil solvent of a chromogenic material which develops colour on contact with a colour developer; and a sub-coat on the paper base and beneath the microcapsule coating;

characterized in that the sub-coat comprises plastic pigment particles and a binder.

The invention also extends to pressure-sensitive copying sets incorporating pressure-sensitive copying paper as just defined.

The plastic pigment particles used in the sub-coat are of a polymer which has little or no binding power and is non-film forming under the conditions in which it is used, i.e. in application to the web, drying and finishing, e.g. calendering. The plastic pigment particles may be hollow, or solid. Of these, hollow plastic pigment particles have so far been found to give the better imaging performance, but they have the drawback of being more expensive. The sub-coat preferably also comprises inorganic pigment particles as conventionally used in paper coating, for example particles of calcium carbonate, kaolin or calcined kaolin. The binder for the sub-coat may be, for example, a conventional paper coating binder such as a styrene-butadiene latex, preferably with polyvinyl alcohol ("PVOH") also present in the formulation. If a latex is used without PVOH, the sub-coat tends to crack to an unacceptable extent. Alternatives to PVOH for preventing cracking include other water-soluble film forming polymers such as carboxymethylcellulose.

The sub-coat is typically formulated at a solids content within the range 30 to 50%. The dry coatweight of the sub-coat is typically from about 3 to about 6 g $m^{-2}$. The plastic pigment particles typically make up from about 20% to 90% of the sub-coat, but this is not thought to be critical. Even at the lower end of this range, worthwhile benefits were still observed.

An example of suitable hollow plastic pigment particles are the hollow acrylic/styrene beads sold under the trademark "Ropaque OP-90" by Rohm & Haas Company of Philadelphia, USA. These beads are supplied in emulsion form at 37% solids content and are initially filled with water. When applied as a coating to paper and dried, the water permanently diffuses from the core of the particle and is replaced by air, i.e. a hollow particle is produced. The average particle size is of the order of 0.4 micron. The acrylic/styrene polymer of which the particles are made is non-film-forming and has little or no binding power.

A further example of suitable hollow plastic pigment particles are "Ropaque E2835" polymer particles, also from Rohm & Haas Company. These are chemically similar to "Ropaque OP-90" plastic pigment particles, but differ physically, in that the primary hollow particles are joined together in an agglomerate structure which includes additional voids between individual hollow primary particles. "Ropaque E2835" plastic pigment particles are supplied in emulsion form at 27% solids content.

An example of suitable solid plastic pigment particles are the carboxylated polystyrene pigment particles sold under the trademark "Plastic Pigment 722E" by The Dow Chemical Company. These particles are supplied in 50% solids content emulsion form and have an average particle size of the order of 0.45 micron. The carboxylated polystyrene of which the particles are made is non-film-forming.

The coating method used to apply the sub-coat to the paper base is not critical, and may be, for example, blade coating or metering roll coating, on- or off-machine.

The present pressure-sensitive copying paper may be used for both the CB and CFB sheets of a pressure-sensitive copying set of the transfer type described above. When used for making CFB sheets, the paper carries a colour developer coating on its surface opposite the surface carrying the microcapsules. Billblade coating is a particularly suitable on-machine coating method for producing paper for CFB sheets, since it permits simultaneous blade application of colour developer coating to one surface of the paper and roll application of sub-coat to the other surface of the paper. The sub-coated surface is then microcapsule coated in a separate operation. The roll coating element of the Billblade coater may be equipped with a wire wound high speed metering roll to facilitate the application of an adequate coatweight of sub-coat.

Although the present invention finds particular application in pressure-sensitive copying paper of the transfer type, it may also be applied to microcapsule-coated pressure-sensitive copying papers of the so-called self-contained type, i.e. papers in which both colour developer composition and microcapsules containing chromogenic materials in solution are present in one or more coatings on the same surface of the paper. Such papers are well-known in the art and so will not be described further herein.

Apart from the sub-coat, the present pressure-sensitive copying paper may be conventional. Such paper is very widely disclosed in the patent and other literature, and so will not be discussed extensively herein. By way of example, however:

(i) the microcapsules may be produced by coacervation of gelatin and one or more other polymers, e.g. as described in U.S. Pat. Nos. 2,800,457; 2,800,458; or 3,041,289; or by in situ polymerisation of polymer precursor material, e.g. as described in U.S. Pat. Nos. 4,001,140; and 4,105,823;

(ii) the chromogenic materials used in the microcapsules may be phthalide derivatives, such as 3,3-bis(4-dimethylaminophenyl)-6-dimethylaminophthalide (CVL) and 3,3-bis(1-octyl-2-methylindol-3-yl)phthalide, or fluoran derivatives, such as 2'-anilino-6'-diethylamino-3'-methylfluoran; 6'-dimethylamino-2'-(N-ethyl-N-phenylamino-4'-methylfluoran), and 3'-chloro-6'-cyclohexylaminofluoran;

(iii) the solvents used to dissolve the chromogenic materials may be partially hydrogenated terphenyls, alkyl naphthalenes, diarylmethane derivatives, dibenzyl benzene derivatives, alkyl benzenes and biphenyl derivatives, optionally mixed with diluents or extenders such as kerosene;

(iv) the colour developer material, when present, may be an acid clay, e.g. as decribed in U.S. Pat. No. 3,753,761; a phenolic resin, e.g. as described in U.S. Pat. Nos. 3,672,935 or 4,612,254; or an organic acid or metal salt thereof, e.g. as described in U.S. Pat. No. 3,024,927.

The thickness and grammage of the present paper (before microcapsule coating) may also be conventional, for example the thickness may be about 60 to 90 microns and the grammage about 35 to 50 g $m^{-2}$, or higher, say up to about 90 g $m^{-2}$. This grammage depends to some extent on whether the final paper is for CB or CFB use. The higher grammages just quoted are normally applicable only to speciality CB papers.

The invention will now be illustrated by the following Examples in which all parts and percentages are by weight unless otherwise stated:

EXAMPLE 1

This illustrates the use of a sub-coat comprising hollow plastic pigment particles ("HPPP"). The sub-coat formulation was applied by means of a blade coater to conventional surface sized 48 g $m^{-2}$ base paper as used in commercial production of carbonless copying paper at a solids content of 32.3% and a wet coatweight of about 15 g $m^{-2}$ (5 g $m^{-2}$ dry). The sub-coat formulation (A), on a dry basis, was as follows:

| (A) | Wet wt (kg) | % Dry |
|---|---|---|
| HPPP ("Ropaque OP-90") | 2300 | 85 |
| PVOH (14.3% solids content) | 700 | 10 |
| Latex (50% solids content) | 100 | 5 |
| | 3100 | 100 |

The PVOH was that supplied as "Poval 105" by Kuraray of Japan. The latex was a styrene-butadiene latex supplied as "Enichem 5594" by Enichem Elastomers Ltd., of Southampton, England.

The sub-coat was calendered conventionally, steel to steel, after it had been applied at a pressure of about 5.6 $Nm^{-1}$ (32 pli).

The thus sub-coated paper was then coated by means of a metering roll coater with a conventional microcapsule coating composition to produce CB paper. A range of microcapsule coatweights was applied. The coating composition contained, in addition to the microcapsules, a binder formulation and a mixture of ungelatinized starch and cellulose fibre floc for preventing premature microcapsule rupture on handling and storage of the paper. The microcapsules each contained a solution of a conventional blend of chromogenic materials in a mixed hycrocarbon oil. The chromogenic material blend was effective to give a black copy image when used with a conventional acid-washed montmorillonite clay colour developer sheet. In order to provide a control for comparison purposes, the same microcapsule coating composition was coated on to base paper which was the same as described above except that it did not carry the sub-coat.

Both the microcapsule-coated papers were tested by means of the Calender Intensity test. This involved superimposing a strip of the microcapsule-coated paper under test onto a strip of conventional acid-washed montmorillonite colour developer coated paper, passing the superimposed strips through a laboratory calender to rupture the capsules and thereby produce a colour on the colour developer strip, measuring the reflectance of the thus-coloured strip (I) and expressing the result ($I/I_o$) as a percentage of the reflectance of an unused control colour developer strip ($I_o$). Thus the lower the calender intensity value ($I/I_o$) the more intense the developed colour.

The reflectance measurements were done both two minutes after calendering and forty-eight hours after calendering, the sample being kept in the dark in the interim. The colour developed after two minutes is primarily due to rapid-developing colour formers in the colour former blend, whereas the colour after forty-eight hours derives also from slow-developing colour formers in the blend (fading of the colour from the rapid-developing colour formers also influences the intensity achieved).

In each case the calender intensity value is indicative of the ability of the microcapsule-coated paper to give rise to a good copy image.

The results obtained for sub-coated papers of two different microcapsule coatweights are set out in Table 1 below, together with the results for two of the control microcapsule-coated papers which were not sub-coated but which had microcapsule coatweights the same or nearly the same as those of the sub-coated microcapsule-coated papers.

TABLE 1

| Microcapsule | | Calender Intensity | |
|---|---|---|---|
| Coatweight (g $m^{-2}$) | Paper Type | 2 min. | 48 hours |
| 5.4 | sub-coated | 52.4 | 43.5 |
| 5.4 | control | 60.2 | 52.2 |
| 3.8 | sub-coated | 54.4 | 46.3 |
| 3.7 | control | 62.8 | 54.3 |

It will be seen that the sub-coated paper gave significant colour intensity benefits compared with the control paper.

EXAMPLE 2

This illustrates the use of sub-coats comprising both hollow plastic pigment particles and particles of an inorganic pigment, namely calcium carbonate. Control sub-coats containing no hollow plastic particles were also applied. The procedure, including the subsequent coating with microcapsules, was generally as described in example 1. The target dry coatweight for the microcapsule coating was 4.8 g $m^{-2}$. The target coatweight of the sub-coat was 5 to 6 g $m^{-2}$, and the sub-coat was calendered as described in Example 1. A control paper with no sub-coat was also microcapsule coated.

The sub-coats used are detailed below as formulations (B) to (J). In these formulations, the hollow plastic pigment particles ("HPPP") were always "Ropaque OP-90" (37% solids content), the PVOH was always "Poval 105" (14.3% solids content), and the latex was always "Enichem 5594" (50% solids content).

| (B) | Wet wt (kg) | % Dry |
|---|---|---|
| HPPP | 129.3 | 77.6 |
| PVOH | 35.4 | 8.3 |
| $CaCO_3$* | 3.0 | 5.0 |
| Latex | 11.1 | 9.1 |
| | 178.8 | 100.0 |

*Calopake F" supplied in solid form (i.e. 100% solids content) by Sturge Lifford, a British subsidiary of Rhone-Poulenc of France.

(C) As (B) above, except that the calcium carbonate was "Hydrocarb 90" supplied as a 75% solids content slurry by Croxton & Garry, of Droking, England as agents for Pluess Stauffer A.G. of Switzerland.

| (D) | Wet wt (kg) | % Dry |
|---|---|---|
| HPPP | 121.5 | 65.4 |
| PVOH | 33.3 | 7.0 |
| $CaCO_3$ ("Calopake F") | 13.6 | 20.0 |
| Latex | 10.5 | 7.7 |
| | 178.9 | 100.1 |

(E) As (D) above, except that the calcium carbonate was "Hydrocarb 90".

| | Wet wt (kg) | % Dry |
|---|---|---|
| (F) | | |
| HPPP | 141.6 | 65.4 |
| $CaCO_3$ ("Calopake F") | 16.0 | 20.0 |
| Latex | 23.5 | 14.7 |
| | 181.1 | 100.1 |
| (G) | | |
| HPPP | 102.6 | 52.0 |
| PVOH | 41.0 | 8.0 |
| $CaCO_3$ ("Calopake F") | 22.8 | 30.0 |
| Latex | 15.2 | 10.0 |
| | 181.1 | 100.0 |
| (H) | | |
| HPPP | 85.4 | 40.0 |
| PVOH | 44.2 | 8.0 |
| $CaCO_3$ ("Calopake F") | 31.6 | 40.0 |
| Latex | 19.0 | 12.0 |
| | 180.2 | 100.0 |
| (I) Control | | |
| Water | 20.0 | — |
| Carboxymethylcellulose (CMC) | 64.0 | 3.2 |
| Calcined kaolin | 62.0 | 62.0 |
| $CaCO_3$ ("Hydrocarb 90") | 13.0 | 13.0 |
| Latex | 43.6 | 21.8 |
| | 202.6 | 100.0 |

The calcined kaolin was that supplied as "Alphatex" by Anglo-American Clays of Atlanta, Ga., USA. The CMC solids content was 5%. The pH of the mix was adjusted to 8.0 with sodium hydroxide prior to addition of the latex. Additional water was added subsequently to lower the viscosity of the mix.

| (I) Control | Wet wt (kg) | % Dry |
|---|---|---|
| Kaolin | 98.0 | 70.0 |
| Latex | 84.0 | 30.0 |
| CMC (5% solids) | 8.4 | (0.3) |
| | 190.4 | 100.0 |

The kaolin was that sold as "SPS" by English China Clays of St. Austell, England. Water was subsequently added to lower the solids content of the mix.

The results obtained on calender intensity testing of the sub-coated and microcapsule-coated papers are set out in Table 2 below:

TABLE 2

| | Sub-Coat formulation | Calender Intensity 2 min. | Calender Intensity 48 hour |
|---|---|---|---|
| B | (77.6% HPPP/5% $CaCO_3$) | 38.5 | 31.7 |
| C | (77.6% HPPP/5% $CaCO_3$) | 38.8 | 31.2 |
| D | (65.4% HPPP/20% $CaCO_3$) | 39.1 | 32.5 |
| E | (65.4% HPPP/20% $CaCO_3$) | 38.7 | 31.6 |
| F | (65.4% HPPP/20% $CaCO_3$ but no PVOH) | 37.7 | 31.2 |
| G | (52% HPPP/30% $CaCO_3$) | 41.3 | 34.3 |
| H | (40% HPPP/40% $CaCO_3$) | 43.6 | 38.0 |
| I | (Control-calcined kaolin $CaCO_3$) | 50.0 | 42.3 |
| J | (Control-kaolin) | 53.5 | 45.7 |
| | No sub-coat | 57.0 | 50.4 |

It will be seen from the data in table 2 that:

a) all the sub-coats applied gave a more intense colouration than the paper with no sub-coat;

b) all the sub-coats incorporating hollow plastic pigment particles gave a more intense colouration than the two control sub-coats (I) and (J) with no hollow plastic pigment particles;

c) increasing the proportion of calcium carbonate filler, and, correspondingly, decreasing the proportion of hollow plastic pigment particles had little effect on the intensity of colouration up to about 20% filler content (down to about 65% hollow plastic pigment particle content) but that above this filler content there was a slight decrease in intensity of colouration;

d) omission of polyvinyl alcohol had little effect on intensity of colouration; and e) the type of calcium carbonate filler used with the hollow plastic pigment particles had little effect on the intensity of colouration.

EXAMPLE 3

This illustrates the use of a further range of sub-coat formulations utilising solid or hollow plastic pigment articles ("SPPP" or "HPPP" respectively), a different 50% solids content styrene-butadiene latex ("Dow DL950", previously known as "Dow XZ94310", supplied by Dow Chemical), and different relative amounts of polyvinyl alcohol ("PVOH") and latex. The HPPP were "Ropaque OP-90" particles as referred to previously, and the SPPP were "Plastic Pigment 722E" particles, also as referred to previously. The PVOH used was always "Poval 105". The plastic pigment content and the calcium carbonate filler content were the same in each formulation (65.4% and 20.0% respectively).

The procedure employed, including subsequent coating with microcapsules, was generally as described in Example 2. The sub-coat dry coatweight was approximately 6 g $m^{-2}$. A control paper with no sub-coat was also microcapsule-coated.

The sub-coats used are detailed below as formulations (K) to (Q):

| | Wet wt (kg) | % Dry |
|---|---|---|
| (K) | | |
| HPPP | 121.5 | 65.4 |
| PVOH | 33.3 | 7.0 |
| $CaCO_3$ ("Calopake F") | 13.6 | 20.0 |
| Latex | 10.5 | 7.7 |
| | 178.9 | 100.1 |

-continued

| | Wet wt (kg) | % Dry |
|---|---|---|
| (L) | | |
| HPPP | 97.2 | 65.4 |
| PVOH | 26.6 | 7.0 |
| $CaCO_3$ ("Hydrocarb 90") | 14.5 | 20.0 |
| Latex | 8.4 | 7.7 |
| | 146.7 | 100.1 |
| (M) | | |
| SPPP | 136.3 | 65.4 |
| PVOH | 50.0 | 7.0 |
| $CaCO_3$ ("Calopake F") | 20.0 | 20.0 |
| Latex | 15.4 | 7.7 |
| Water | 5.8 | — |
| | 227.5 | 100.1 |
| (N) | | |
| HPPP | 121.5 | 65.4 |
| PVOH | 23.6 | 4.9 |
| $CaCO_3$ ("Calopake F") | 13.6 | 20.0 |
| Latex | 13.5 | 9.8 |
| | 172.2 | 100.1 |
| (O) | | |
| HPPP | 121.5 | 65.4 |
| PVOH | 17.8 | 3.7 |
| $CaCO_3$ ("Calopake F") | 13.6 | 20.0 |
| Latex | 15.3 | 11.1 |
| | 172.2 | 100.1 |
| (P) | | |
| HPPP | 121.5 | 65.4 |
| PVOH | 14.4 | 3.0 |
| $CaCO_3$ "Calopake F") | 13.6 | 20.0 |
| Latex | 16.2 | 23.6 |
| Water | 6.0 | — |
| | 171.7 | 100.1 |
| (Q) | | |
| SPPP | 136.3 | 65.4 |
| PVOH | 49.0 | 7.0 |
| $CaCO_3$ ("Hydrocarb 90") | 26.7 | 20.0 |
| Latex | 15.4 | 7.7 |
| | 227.4 | 100.1 |

The results obtained on calender intensity testing of the sub-coated and microcapsule-coated papers are set out in Table 3 below, together with the measured dry microcapsule coatweights. Although it was intended to apply approximately the same coatweight to each paper, this was not achieved in practice, perhaps because the roughnesses of the sub-coated papers varied significantly. Table 3 also includes the results of Frictional Smudge (FS) testing.

The Frictional Smudge test provides an indication of the extent to which the microcapsule-coated paper is able to withstand non-imaging pressures to which it may be subjected after manufacture (e.g. when the microcapsule-coated paper is tightly reeled up) or in use (e.g. when the microcapsule coated paper is in a stack of similar paper or when other papers or objects are placed on top of the microcapsule-coated paper).

A sheet of the microcapsule-coated paper was placed under a sheet of colour developing paper, with the colour developing coating in contact with the microcapsule coating. A smooth metal cylinder (weighing about 3.6 kg) was placed on the uncoated surface of the colour developing sheet, and the sheet was pulled so as to slide over the surface of the microcapsule-coated paper, taking the weight with it. The effect of this was that some microcapsules were ruptured. The colour former solution released as a result produced a colour on contact with the colour developing sheet. The reflectance of this coloured area (I) was measured and the result was expressed as a percentage of the reflectance of an unused control colour developing strip ($I_o$). This ratio ($I/I_o$) is termed the frictional smudge (F.S.) value. The higher the F.S. value, the less intense the colour and thus the fewer the number of ruptured microcapsules and the better the ability of the microcapsule-coated paper to withstand the non-imaging pressures outlined above.

TABLE 3

| Sub-coat Formulation | Microcapsule Coatweight (dry) | Calender Intensity 2 min. | Calender Intensity 48 hours | FS(%) |
|---|---|---|---|---|
| K | 3.9 | 35.7 | 3.2 | 84.0 |
| L | 5.7 | 36.1 | 31.4 | 81.0 |
| M | 4.2 | 42.3 | 36.9 | 90.6 |
| N | 5.2 | 35.7 | 30.8 | 80.2 |
| O | 4.4 | 35.8 | 31.0 | 82.1 |
| P | 4.3 | 34.9 | 30.5 | 82.5 |
| Q | 4.7 | 44.0 | 39.6 | 91.7 |
| None | 4.7 | 56.3 | 50.8 | 96.0 |

The differing microcapsule coatweights make direct comparisons difficult but the following points can be made:

a) The results for formulations (K) and (M), which differ only in using hollow and solid plastic pigment particles respectively indicate that a stronger colouration is obtained with the hollow pigment than with the solid pigment.

b) The results for formulations (N), (O) and (P) which differ only in the PVOH: latex ratio (1:2; 1:3 and 1:4) indicate that this ratio is of little significance.

c) The results for formulations (M) and (Q) which differ only in the type of calcium carbonate used indicate that calcium carbonate type is of little significance.

d) All the sub-coated papers gave much higher colour intensity than the control paper with no sub-coat.

e) Whilst the sub-coats all lessened the Frictional Smudge values, all the papers were acceptable in this respect.

EXAMPLE 4

This illustrates the use of a further range of sub-coat formulations (R) to (V) utilising solid or hollow plastic pigment particles ("SPPP" or "HPPP" respectively). A control sub-coat with no plastic pigment was also tried. A different 50% solids content styrene-butadiene latex ("Dow 675" supplied by Dow Chemical) was used compared with previous Examples. The HPPP were "Ropaque OP-90" particles in formulation (T) and "Ropaque E2835" particles in formulations (U) to (W). The SPPP were "Plastic Pigment 722E" particles. The PVOH used was always "Poval 105". The HPPP content in formulations (U) to (W) was varied to investigate further the influence of the level of HPPP used.

The procedure employed, including subsequent coating with microcapsules, was generally as described in Example 3. Each sub-coat formulation was coated at a range of dry coatweights. The sub-coat formulations were applied at a solids content in the range 32 to 36%. All the sub-coats were calendered conventionally, steel to steel, at a pressure of about 5.6 $Nm^{-1}$ (32 pli). Some of the paper sub-coated with formulation (T) was left uncalendered, in order to assess the effect of calendering. A control paper with no sub-coat was also microcapsule-coated.

The sub-coats used are detailed below as formulations (R) to (W):

| | Wet Wt (kg) | % Dry |
|---|---|---|
| (R) | | |
| SPPP | 15.0 | 55.4 |
| PVOH | 21.0 | 3.0 |
| $CaCO_3$ "Hydrocarb 90") | 40.0 | 30.0 |
| Latex | 23.0 | 11.6 |
| Water | 86.0 | — |
| | 285.0 | 100.0 |
| (S) Control) | | |
| PVOH | 42.0 | 6.6 |
| $CaCO_3$ ("Hydrocarb 90") | 80.0 | 67.4 |
| Latex | 46.0 | 26.0 |
| Water | 54.0 | — |
| | 222.0 | 100.0 |
| (T) | | |
| HPPP | 75.0 | 55.4 |
| PVOH | 10.5 | 3.0 |
| $CaCO_3$ ("Hydrocarb 90") | 20.0 | 30.0 |
| Latex | 11.6 | 11.6 |
| Water | 25.0 | — |
| | 227.5 | 100.0 |
| (U) | | |
| HPPP | 164.0 | 55.4 |
| PVOH | 17.0 | 3.0 |
| $CaCO_3$ ("Hydrocarb 90") | 32.0 | 30.0 |
| Latex | 18.0 | 11.6 |
| | 231.0 | 100.0 |
| (V) | | |
| HPPP | 130.0 | 35.0 |
| PVOH | 21.0 | 3.0 |
| $CaCO_3$ ("Calopake F") | 50.0 | 50.0 |
| Latex | 24.0 | 12.0 |
| Water | 60.0 | — |
| | 285.0 | 100.0 |
| (W) | | |
| HPPP | 93.0 | 25.0 |
| PVOH | 21.0 | 3.0 |
| $CaCO_3$ ("Calopake F") | 60.0 | 60.0 |
| Latex | 24.0 | 12.0 |
| Water | 87.0 | — |
| | 285.0 | 100.0 |

The results obtained on Calender Intensity and Frictional Smudge testing of the sub-coated and microcapsule-coated papers are set out in Table 4 below, together with the measured dry microcapsule coatweights. The "Ropaque E2835" plastic pigment is composed of agglomerated hollow particles as described previously, and is therefore denoted AHPPP in Table 4 for ease of comparison.

TABLE 4

| Sub-coat Formulation | Microcapsule Coatweight (dry) | Calender Intensity 2 min. | Calender Intensity 48 hours | FS(%) |
|---|---|---|---|---|
| No sub-coat | 2.9 | 73.1 | 65.6 | 95.5 |
| (control) | 3.5 | 68.3 | 63.0 | 95.8 |
| | 4.8 | 65.5 | 60.5 | 96.0 |
| | 4.8 | 64.8 | 57.3 | 95.2 |
| | 5.4 | 60.8 | 56.0 | 95.8 |
| (R) | 2.5 | 65.5 | 57.9 | 95.2 |
| SHPP (55%) | 3.5 | 61.8 | 56.7 | 93.6 |
| | 4.1 | 59.9 | 53.2 | 94.9 |
| | 4.4 | 60.5 | 52.5 | 95.6 |
| | 5.2 | 58.5 | 53.0 | 96.0 |
| (S) | 2.9 | 66.8 | 60.7 | 95.6 |
| (Control | 4.4 | 63.5 | 55.9 | 96.0 |
| subcoat) | 5.0 | 61.3 | 54.0 | 94.4 |
| | 6.3 | 59.5 | 52.8 | 95.2 |
| (T) | 3.7 | 58.8 | 52.1 | 94.8 |
| (calendered) | 4.1 | 56.2 | 49.3 | 93.2 |
| HPPP (55%) | 5.2 | 55.0 | 48.7 | 94.4 |
| | 5.6 | 54.9 | 46.1 | 92.5 |
| | 5.7 | 53.1 | 46.6 | 92.4 |
| (T) | 3.4 | 55.2 | 48.1 | 92.8 |

TABLE 4-continued

| Sub-coat Formulation | Microcapsule Coatweight (dry) | Calender Intensity 2 min. | Calender Intensity 48 hours | FS(%) |
|---|---|---|---|---|
| (uncalen-) | 4.9 | 53.7 | 47.7 | 92.0 |
| dered) | 5.2 | 53.7 | 45.4 | 94.8 |
| | 6.0 | 51.6 | 45.2 | 94.0 |
| (U) | 3.0 | 56.1 | 47.6 | 85.7 |
| AHPPP (55%) | 3.4 | 54.0 | 47.2 | 88.0 |
| | 4.3 | 50.7 | 42.9 | 90.0 |
| | 4.7 | 49.6 | 42.3 | 90.0 |
| | 5.6 | 48.1 | 42.4 | 91.1 |
| (V) | 2.6 | 59.1 | 52.9 | 92.4 |
| HPPP (35%) | 3.9 | 56.3 | 48.5 | 90.8 |
| | 4.1 | 53.7 | 46.5 | 92.4 |
| | 5.4 | 52.5 | 44.3 | 94.8 |
| (W) | 3.6 | 62.3 | 54.0 | 93.6 |
| HPPP (25%) | 3.4 | 58.5 | 50.6 | 94.0 |
| | 4.3 | 56.6 | 48.2 | 95.2 |
| | 5.1 | 56.5 | 47.8 | 94.8 |

It will be seen from the data in Table 4 that:

a) All the subcoated papers, including the control subcoat with no plastic pigment, gave significant intensity improvements (i.e. lower CI values) at comparable microcapsule coatweights.

b) All the intensity values obtained with the control subcoat without plastic pigment were significantly worse (i.e. higher CI values), at comparable microcapsule coatweights, than the intensities obtained with the various subcoats according to the invention.

c) The hollow plastic pigment subcoats gave improved intensities (i.e. lower CI values) at the same plastic pigment level and at comparable microcapsule coatweights, than the solid plastic pigments.

d) The agglomerated hollow plastic pigment subcoats gave higher intensities (i.e. lower CI values), at the same plastic pigment level and at comparable microcapsule coatweights, than the unagglomerated hollow plastic pigments.

e) Calendering the hollow plastic pigment particles resulted in a slight loss in intensity, (i.e. higher CI values) at comparable microcapsule coatweights. Calendering may however be desirable for other reasons, and the results obtained are therefore significant in demonstrating that calendering has only a marginal effect on intensity and does not therefore negate the other benefits obtained.

f) Reduction in the proportion of hollow plastic pigment particles in the subcoat reduced the intensity values obtained (i.e. gave higher CI values).

g) Frictional Smudge values were little affected, compared with the values for no subcoat, by the presence of the control subcoat or the solid plastic pigment subcoat, but they did decline (i.e. lower FS values) in the case of the hollow plastic pigment subcoats. This decline was not such as to negate the value of the intensity benefits obtained.

The above discussion highlights the intensity benefits achievable with the present subcoats. However, the benefit of the invention may also be viewed as making possible the achievement of a particular given intensity at a lower microcapsule coatweight than is possible in the absence of the present subcoat. For example, to achieve a 48 hour CI value of about 56, a dry microcapsule coatweight of 5.4 g $m^{-2}$ is required with no subcoat, 4.4 g $m^{-2}$ with the control subcoat, and only 3.5 g m-2 with the solid plastic pigment subcoat. Savings in microcapsule coatweight are particularly significant as microcapsule coatings are expensive compared with subcoat or colour developer coatings.

EXAMPLE 5

This illustrates the use of a Billblade coater for applying a subcoat according to the invention to one surface of a paper web whilst simultaneously applying a colour developer coating to the other surface. The colour developer coating was applied and metered by the blade half of the Billblade coater, and the subcoat by the roll half. The latter was equipped with a wire wound high speed metering roll to facilitate application of the desired wet coatweights. All the coated papers were calendered conventionally, steel to steel, at a pressure of about 5.6 $Nm^{-1}$ (32 pli). A microcapsule coating was subsequently applied over the subcoat by means of a metering roll coater to produce CFB paper at a range of microcapsule coatweights.

The subcoat formulation (c. 35% solids content) was as follows:

| | Wet wt. (kg) | % Dry |
|---|---|---|
| SPPP ("Plastic Pigment 722E") | 262.0 | 55.4 |
| $CaCO_3$ ("Calopake F") | 68.0 | 30.0 |
| Latex ("Dow 675") | 53.0 | 11.6 |
| PVOH ("poval 105") | 48.0 | 3.0 |
| Water | 220.0 | — |
| | 651.0 | 100.0 |

The subcoat was applied at four different coatweights, namely 3.7, 3.8, 4.0 and 4.8 g $m^{-2}$ (these values are approximate).

The colour developer coating was of a conventional formulation based on acid-washed dioctahedral montmorillonite clay as the active colour developing component, kaolin as a diluent, and styrene-butadiene latex as a binder, applied at a dry coatweight of approximately 7 g $m^{-2}$.

The microcapsule coating was generally as described in Example 1.

The base paper used was as conventionally used for making CFB paper and had a grammage of 38 g $m^{-2}$. A comparable standard commercially-available acid washed dioctahedral montmorillonite/kaolin colour developer coated paper (38 g $m^{-2}$ base paper with an 8 g $m^{-2}$ colour developer coating and no subcoat) was also microcapsule coated to provide a control.

The results obtained on Calender Intensity and Frictional Smudge testing of the subcoated and microcapsule coated papers are set out in Table 5 below, together with the measured dry sub-coat, colour developer (CF), and microcapsule coatweights.

| Coatweight (g $m^{-2}$) of (a) Subcoat (b) CF | Microcapsule Coatweight (dry) | Calender Intensity 2 min. | Calender Intensity 48 hours | FS(%) |
|---|---|---|---|---|
| (a) zero | 3.9 | 67.1 | 58.0 | 96.8 |
| (b) c.8 | 5.0 | 63.7 | 56.4 | 95.8 |
| (control) | 5.3 | 63.2 | 56.2 | 95.2 |
| | 6.0 | 60.8 | 54.4 | 95.6 |
| | 6.8 | 60.5 | 52.9 | 95.6 |
| (a) 4.0 | 3.6 | 67.7 | 61.2 | 94.6 |
| (b) 9.0 | 4.5 | 65.7 | 57.9 | 93.4 |
| | 4.2 | 62.4 | 53.0 | 94.3 |
| | 4.3 | 61.0 | 52.0 | 94.3 |
| | 5.8 | 57.0 | — | 94.8 |
| (a) 4.8 | 3.2 | 66.1 | 59.5 | 93.6 |

-continued

| Coatweight (g $m^{-2}$) of (a) Subcoat (b) CF | Microcapsule Coatweight (dry) | Calender Intensity 2 min. | Calender Intensity 48 hours | FS(%) |
|---|---|---|---|---|
| (b) 8.9 | 3.1 | 63.3 | 55.8 | 94.0 |
| | 4.3 | 59.9 | 53.5 | 93.6 |
| | 4.0 | 58.5 | 51.6 | 92.9 |
| | 4.7 | 59.0 | 52.6 | 94.9 |
| (a) 3.8 | 2.6 | 72.0 | 62.9 | 94.8 |
| (b) 8.8 | 3.7 | 67.2 | 59.2 | 96.4 |
| | 4.4 | 67.5 | 59.2 | 94.4 |
| | 4.6 | 63.2 | 55.6 | 96.0 |
| | 5.4 | 62.3 | 55.2 | 94.9 |
| (a) 3.7 | 2.6 | 72.2 | 63.9 | 95.6 |
| (b) 6.5 | 3.0 | 68.8 | 61.7 | 95.2 |
| | 4.0 | 66.4 | 58.4 | 95.6 |
| | 5.3 | 62.8 | 55.5 | 94.4 |
| | 5.8 | 62.8 | 53.5 | 94.0 |

It will be seen that the intensity values for the control paper and the 4.8 g $m^{-1}$ subcoat paper were approximately the same, even though the microcapsule coatweight for the subcoated paper was significantly lower. A similar conclusion can be drawn from the results for the 4.0 g $m^{-2}$ subcoat paper, although reliable comparison is difficult because the coatweight figures are only approximate. The results for the other two subcoated papers show little or no benefit compared with control. Given the other results for subcoated papers in this and other Examples, it is thought likely that the lack of benefit is the result of insufficient subcoat being present in this instance.

The Frictional smudge test results also show comparable performance with the control for the two higher coatweight subcoated papers, but a slight decline relative to control for the two lower coatweight subcoated papers.

EXAMPLE 6

This also illustrates the use of a subcoat in a CFB paper. It differs from Example 5 in that the subcoat was applied in a separate blade coating operation after the colour developer coating has been applied to the base paper web and dried rather than being applied simultaneously by means of a Billblade coater as in Example 5. The subcoat dry coatweight was 3.5 g $m^{-2}$. The subcoated paper was then microcapsule coated as described in Example 5.

The subcoat, colour developer and microcapsule coating formulations were as described in Example 5. A colour developer coated paper with no subcoat was also microcapsule coated to provide a control.

The colour developer paper to which the subcoat and microcapsule coatings were applied was as described for the control paper in Example 5.

The results obtained on Calender Intensity and Friction Smudge testing of the subcoated and microcapsule coated papers are set out in Table 6 below, together with the measured microcapsule coatweights.

TABLE 6

| Paper | Microcapsule Coatweight (dry) | Calender Intensity 2 min. | Calender Intensity 48 hours | FS(%) |
|---|---|---|---|---|
| Control | 4.7 | 66.0 | 56.9 | 98.0 |
| (no subcoat) | 5.1 | 64.0 | 55.4 | 96.4 |
| | 5.5 | 61.7 | 53.4 | 97.6 |
| | 6.4 | 58.6 | 51.5 | 96.4 |
| | 6.9 | 58.9 | 51.0 | 97.6 |
| Subcoated | 3.8 | 66.3 | 57.5 | 96.0 |

TABLE 6-continued

| Paper | Microcapsule Coatweight (dry) | Calender Intensity 2 min. | 48 hours | FS(%) |
|---|---|---|---|---|
| | 4.2 | 60.2 | 51.6 | 96.8 |
| | 4.8 | 56.5 | 49.1 | 95.6 |
| | 4.7 | 53.3 | 45.7 | 95.2 |
| | 5.5 | 54.3 | 47.1 | 95.2 |

It will be seen that at comparable coatweights, the subcoated paper showed markedly better intensities (i.e. lower CI values) or, conversely, that for a given intensity value, the subcoated paper required a much smaller micocaspule coatweight. There was a slight lowering in the FS value for the subcoated paper compared with the control.

We claim:

1. Pressure-sensitive copying paper comprising:

a paper base;

a coating of pressure-rupturable microcapsules on the paper base, the microcapsules containing a solution in an oil solvent of a chromogenic material which develops colour on contact with a colour developer; and a subcoat on the paper base and beneath the microcapsule coating;

the subcoat comprising plastic pigment particles and a binder.

2. Pressure-sensitive copying paper as claimed in claim 1, wherein the plastic pigment particles are hollow.

3. Pressure-sensitive copying paper as claimed in claim 1, wherein the plastic pigment particles are solid.

4. Pressure-sensitive copying paper as claimed in claim 1, wherein the subcoat also comprises inorganic pigment particles.

5. Pressure-sensitive copying paper as claimed in claim 1 wherein the binder is a mixture of a latex and polyvinyl alcohol.

6. Pressure-sensitive copying paper as claimed in claim 1 wherein the subcoat is present at a dry coatweight of from about 3 to about 6 g $m^{31\ 2}$.

7. Pressure-sensitive copying paper as claimed in claim 1 wherein the plastic pigment particles make up from about 20% to about 90% by weight of the subcoat.

8. Pressure-sensitive copying sets incorporating pressure-sensitive copying paper comprising:

a paper base;

a coating of pressure-rupturable microcapsules on the paper base, the microcapsules containing a solution in an oil solvent of a chromogenic material which develops colour on contact with a colour developer; and a subcoat on the paper base and beneath the microcapsule coating;

the subcoat comprising plastic pigment particles and a binder.

* * * * *